United States Patent [19]

Snaper

[11] Patent Number: 4,570,597

[45] Date of Patent: Feb. 18, 1986

[54] FLUIDIALLY CONTROLLED FUEL SYSTEM

[76] Inventor: Alvin A. Snaper, 2800 Cameo Cir., Las Vegas, Nev. 89107

[21] Appl. No.: 628,492

[22] Filed: Jul. 6, 1984

[51] Int. Cl.[4] ..... F02D 3/02

[52] U.S. Cl. ..... 123/444; 123/472; 123/DIG. 10; 261/DIG. 69

[58] Field of Search ..... 123/444, 472, 445, 446, 123/457, DIG. 10; 261/DIG. 69

[56] References Cited

U.S. PATENT DOCUMENTS

| | | | |
|---|---|---|---|
| 2,949,900 | 8/1960 | Bodine | 123/472 |
| 3,655,170 | 4/1972 | Lazar | 123/444 |
| 3,771,505 | 11/1973 | Taplin | 123/444 |
| 3,937,195 | 2/1976 | Woods | 123/444 |

*Primary Examiner*—Andrew M. Dolinar

*Attorney, Agent, or Firm*—Donald D. Mon; David O'Reilly

[57] ABSTRACT

An improved fuel delivery system which combines the advantages of an ultrasonic spray with fluidic metering of fuel. A fuel delivery system is provided which includes a plurality of fluidic controls each of which is responsive to a particular engine condition. The fluidic controls are disposed in fluidic branches to meter fuel flow in response to each engine operating conditions. The fluidic devices are preferably configured in four branches to respond to choke (start), idle, acceleration and cruise conditions to meter fuel to an ultrasonic atomizing spray device.

8 Claims, 2 Drawing Figures

FLUIDIALLY CONTROLLED FUEL SYSTEM

BACKGROUND OF THE INVENTION

Fuel delivery systems, especially those for delivering fuel for an internal combustion engine have not been altogether satisfactory. Particularly inefficient is the typical carburetor for delivering gasoline to an automobile or similar engine. The rate of supply of fuel to the carburetor is controlled by such elements as a float chamber, float and needle valve. The carburetor also includes such components as a throttle valve, regulating screws, inlet valves, springs, nozzle, linkages, and the like. However, as efficient as a well adjusted or tuned carburetion fuel delivery system is for a particular engine, it will not remain so long because of engine and carburetor component wear resulting in changing fuel requirements and deliveries which are not compensated for. Moreover, as such wear and changes continue there results in still further inefficiency of the system. Accordingly, in order to maintain peak, or in some cases even acceptable, engine running and fuel delivery conditions, frequent tune-ups and carburetor adjustments must be made. The carburetor, working on mechanical valves and linkages delivers fuel in response to the amount of accelerator depression and with the exception of an automatic choke, makes no compensation or adjustment for engine condition or wear or efficiency. Also carburetors as well as fuel injection systems often require significant maintenance, and performance is significantly affected by temperature, pressure, vibration and other environmental conditions. In short, presently devised fuel delivery systems simply fall short in achieving precisely measured fuel quantities needed by an engine at any given instant. Yet such fuel delivery is quite important not only for maximum engine performance, regardless of whether it is operating at idle, cruising or accelerating, but also for the sake of fuel economy. It is such problems that the present invention is intended to obviate.

BRIEF DESCRIPTION OF THE INVENTION

The present invention is designed to provide a relatively simple, yet effective system and method for delivering fuel to an internal combustion engine. The system is based on a plurality of fluidic controls, each responsive to an engine condition and demand to meter fuel to an ultrasonic atomizing spray device. The fluidic devices are connected to respond to different engine conditions including choke (start) idle, accelerating and cruise conditions. The fluidic fuel control devices are combined with the ultrasonic spray device to control dispensing fuel to the engine.

Fluidic devices are provided in the form of a network of channels within a block of material for passage of either fluids or gases. The flow of fluids through the passages is controlled by deflecting the flow in response to a pressure control signal applied at a junction of the passageways. The fluidic devices rely on the fluid dynamic principles of the Coanda Effect or the Beam Deflection principle. The former is produced by a pressure control signal applied to a junction of two passageways while the other uses a control pressure to increase (or decrease) flow from one passageway to another. With these dynamic fluidic principles fluidic devices can emulate electronic amplifiers and switches such as flip flops etc. When combined with an ultrasonic atomizing spray apparatus such as that disclosed in U.S. Pat. No. 3,243,122, a very efficient, reliable fuel delivery system can be produced.

It is therefore one object of this present invention to provide an improved fuel delivery system which combines fluidic control with an ultrasonic spray apparatus.

Another object of the invention is to provide an improved fuel delivery system having minimum sensitivity to atmospheric or environmental conditions including temperatures, pressures, and vibrations.

A still further object is to provide a fuel delivery system which has a minimum of moving parts or components thereby substantially reducing wear and improving reliability and system life.

Still another further object is to provide a fuel delivery system having improved performance by delivering precisely metered amounts of fuel in response to specific engine requirements.

Yet another object is to provide a fuel delivery system which monitors engine requirements and delivers fuel in response thereto.

An additional object is to provide a fuel delivery system needing substantially less maintenance than present carburation or fuel injection systems.

DETAILED DESCRIPTION OF THE DRAWINGS

DETAILED DESCRIPTION OF THE INVENTION

Figures 1, 2:
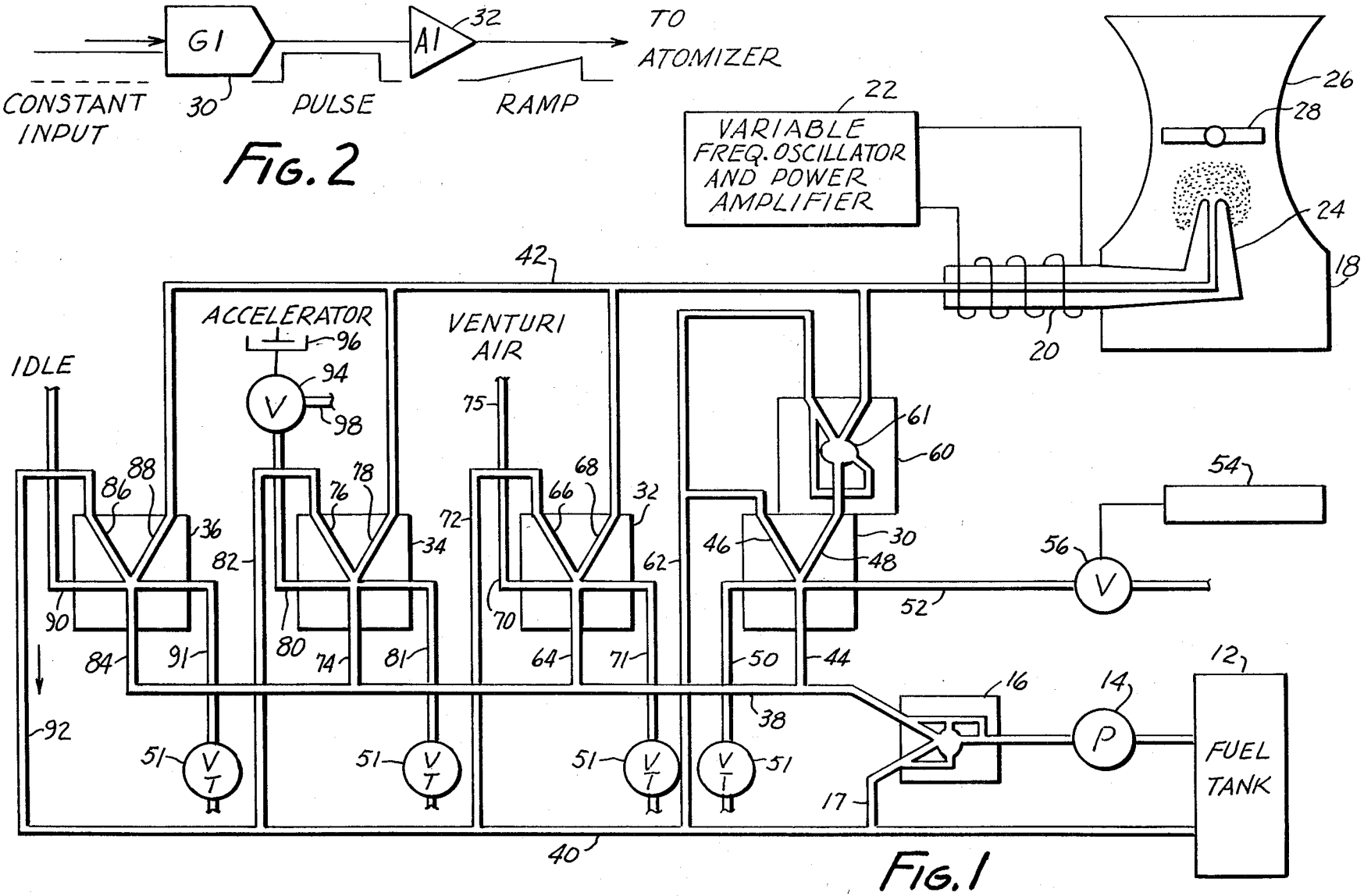
FIG. 1 is a schematic diagram of a fluidic metered control system according to the present invention illustrating the principle of operation for delivering fuel to an internal combustion engine.
FIG. 2 is a schematic diagram illustrating fluidic control of fluid metering.

The fluidic metering system of the invention has several branches with each designed to provide metered fuel flow for a particular engine condition. Four branches are shown to provide for four different engine conditions. These are start (i.e., choke), idle, acceleration and cruise conditions. Each branch has common components. These are fuel tank 12, fuel pump 14, constant pressure fluidic amplifier 16 and an ultrasonic spray apparatus 18 preferably of the type disclosed in U.S. Pat. No. 3,243,122 to the same inventor as the invention disclosed herein, the description of which is incorporated herein by reference. The ultrasonic spray apparatus has a transducer 20 coupled with a variable frequency oscillator and amplifier 22. Transducer 20 converts electrical oscillations to corresponding mechanical vibrations which are transmitted to spray-head element 24, which in turn, atomizes the fuel to be delivered to air intake measuring system comprised of Venturi 26 and butterfly valve 28. The advantages of using the ultrasonic apparatus of the above-identified patent is the wide selection of spray patterns depending on the shape of spray-head 24, low power requirements and ability to instantly provide a full spray pattern. In addition, the ultrasonic spray will atomize a volume of fuel in uniform droplets in the desired spray pattern. Further details of the atomizing component will be more fully explained hereinafter.

In the fuel metering system of FIG. 1 the fuel pump 14 and constant pressure fluidic amplifier 16 deliver and maintain fuel pressure in the lines to the fluidic metering system. Preferably, pump 14 is a constant pressure pump which helps maintain constant pressure in the system. This helps keep the fluidic controls independent of pressure while metering the flow of fuel. Accordingly, for maximum efficiency it is desirable to maintain constant pressure throughout the system. Therefore it is desirable to have a pump which includes means for sensing and correcting pressure changes in the fuel flow system. Alternatively, a surge tank or regulator (not shown) may be installed to cooperate with a standard fuel pump. A constant pressure fluidic element 16 between the fuel pump 14 and the fluidic controls is also desirable and will be described in further detail hereinafter.

Four individual fluidic controls 30, 32, 33, 34 and 36 are shown in FIG. 1, each responsive to a condition or fuel demand. The fluidic controls are shown in a series - parallel arrangement but may be formed in a single block, having a different spacing or arrangement as will be appreciated by those skilled in the art.

The system has a conduit 18 receiving fuel supplied from fuel tank 12 through pump 14 and constant pressure fluidic component 16. Passageway 40 is a return line directing unused fuel from the fluidic controls back to fuel tank 12. Each fluidic control has a line for returning fuel to return passageway 40. Passageway 42 is a common line connected to the outputs of all the fluidic controls for delivering fuel to the ultrasonic spray device 18.

First fluidic control 30 has an input or fuel supply line 44 and output lines 46 and 48. Control lines 50 and 52 direct fuel to output lines 46 and 49. Fuel is continuously supplied to the fluidic control 30 from pump 14 and constant pressure control 16.

Each of the remaining fluidic controls 32, 34 and 36 have similar arrangements including inlet and outlet lines and ports, control ports and passageways. The controls are shown to be substantially identical for the purpose of illustration only and depending on the respective function of each control, the design of each may be varied to suit the desired purpose. For purposes of this disclosure fluidic controls 30, 32, 34 and 36 are designated as choke control, cruise control, acceleration control, and idle control respectively.

Control of fuel to the engine cylinders during a cold start condition by fluidic component 30 provides the "choke" function. Control line 52 is connected to cooperate with pressure or vacuum sources, such as engine vacuum or manifold pressure providing a control pressure to the fluidic control 30. The pressure applied in turn is determined by sensor 54 which may operate a valve 56. The sensor may be a temperature sensor or voltage sensor responsive to voltages in an ignition coil.

Choke fluidic control 30 controls the delivery of fuel to the engine cylinders during a cold start condition, thus providing the "choke" function. Line 52 is connected to cooperate with pressure or vacuum sources such as engine vacuum or manifold pressure providing a pressure to the fluidic control 30. The application of pressure to a control port may be in response to a sensor 54 operating a valve 56 in line 52. The sensor can be a temperature sensor or a sensor responsive to voltages in the ignition coil. During choke control operation fuel flows from supply conduit 38 to output ports through passageways 44 and 48, to fluidic control 60 from which it flows to the engine via conduit 92 and ultrasonic spray device 18. When the engine is not cold and does not need the additional fuel required for cold starting, fuel will flow through return lines 62 and 40 back to fuel tank 12.

Preferably, the choke fluidic control includes proportional amplifier 60 to vary the fuel flow volume to line 42 depending on the engine temperature at start. Fuel flow according to the specific engine temperature may also vary. For example, sensor 54 may be a static gate or regulator used to control the input control pressure through line 52 while line 50 is vented to the atmosphere or thourgh an adjustable pressure source 51 which provide a reference pressure.

If the engine is at operating temperature, there is no need to provide the choke monitoring. Fuel is supplied to output line 48 only where the engine is at temperatures lower than a minimum normal operating temperature determined by sensor 54. Pressure control supplied from the engine manifold, through control line 52 will cause fuel to be directed through passageway 46, back to the fuel tank 12. An expandable and contractable metallic temperature sensor such as a thermocouple or thermostatic control can be used in cooperation with valve 56 to close line 52 at lower engine temperatures so that manifold pressure will not deflect fuel to passageway 48. With line 52 closed or substantially closed, and control line 50 open and a standard pressure stream entering the control therefrom, fuel will be directed through passageway 48 to be dispersed to the engine during a cold start. As the engine warms and a temperature rise is sensed by thermostat 54, valve 56 will gradually open so that manifold vacuum pressure deflects fuel from passageway 48 to passageway 46. Continued increase in engine temperature will cause temperature sensing thermostat 54 to fully open valve 56 deflecting fuel to passageway 46 for return to fuel tank 12. This condition continues while the engine is warm and until the engine becomes cool or cold to again initiate the choke function.

This example is by way of illustration only and instead of gradually opening control line 52 as engine temperature rises, thermostat 54 or some other temperature sensing control or gate may be used to gradually close line 50. If both control lines are connected to substantially identical pressure sources, with both lines open, approximately one-half of the fuel is directed to each of passageways 46 and 48. Fluidic control device 30 is designed so that the amount of fuel being directed through passageway 48 will be sufficient to provide the fuel needed during engine start-up and the choke operation phase. As the engine begins to warm and thermostat 54 begins to close valve 56 and line 52 decreasing the input pressure at control line 52 will remain relatively high thereby increasing deflection of the fuel stream into passageway 46. When normal engine operating temperature is reached and control line 50 is entirely closed, pressure through control line 52 will cause maximum deflection of the fuel stream through passageway returning fuel to tank 12.

The choke function of fluidic control 30 can be varied to achieve its desired purpose with pressure or vacuum controls selected to cooperate with the control lines in combination with a variety of temperature sensing devices. It should also be understood that by utilizing a proportional amplifier 60 fuel passing through fluidic control 30 may be deflected by control line pressure differences to modulate the fuel metered to each of the output lines 46 and 48. The schematic fluidic control shown illustrates generally a proportional amplifier 60 which includes a chamber 61 to prevent the Coanda effect, normally used for a bi-stable fluidic control element. However, for some types of engines or fuel delivery systems it may be desirable to use of bi-stable fluidic control utilizing the Coanda effect having no proportional distribution of fuel deflected between output lines 46 and 48. Thus when the choke function is required all fuel will flow to output line 48. When a choke function is no longer needed all of fuel flow will be deflected to passageway 46 for return to fuel tank 12. However, since variable choking is usually desirable during gradual engine warm up, proportional amplifier 60 previously described is preferable.

FIG. 2 illustrates operation of fluidic component 30 and proportional fluidic amplifier 60 to meter fuel. Fluidic component 30 is a gate (61) which allows "pulses" of fuel to flow to amplifier A1. When gate 61 is not allowing a pulse of fuel to flow to amplifier it is being returned to fuel tank 12 through return line 62. A pulse of fuel is further modified by amplifier A1 into a "ramp" as illustrated. The "ramp" of fuel flowing to the atomization head 24 contains in total enough fuel to proper air/fuel mixture for one cylinder charge. The beginning of charge is thus lean and the end rich. This lean-increasing-to-rich mixture forms a stratified charge in the cylinder without the use of additional valving or additional separate combustion chambers.

Fluidic components 32, 34 and 36 provide supplementary branches for metering fuel flow under other engine conditions such as cruise, acceleration and idling respectively. Additional supplementary branches could be provided as necessary with proportional fluidic amplifiers if desired. Unlike a conventional carburetor, the metering and atomization are independent functions where one may be modified extensively without effecting the other. For example: the ultrasonic spray head 24 will continue to spray the same pattern and same droplet size regardless of the amount of fuel fed to it up to saturation; or conversely by varying the power to the spray head, one may modify droplet size while maintaining the same fuel per unit time ratio as before.

Fluidic cruise control 32, operates by deflecting fuel between output ports through 66 and 68. Fuel entering input line 64 via supply line 38 is deflected by pressure variation between control lines 70 and 71. The pressure variation may be created by tapping engine vacuum 75, manifold presssure, or other similar means cooperating with the two control lines. One of the control lines may also be vented to the atmosphere through a valve restriction 51 or other standard reference means. The cruise control branch functions by deflecting an amount of fuel entering inlet line 64 to outlet line 68 required for operating the engine at a near constant speed. Since there is also an idle fluidic control member in the series, normally, when the engine fuel requirement demands are only for idling speed, the cruise fluidic control will deflect fuel to an outlet port from line 66 for return to the fuel tank through line 72. However, once engine demands for cruising speeds are greater than idle or stand still, fuel will be metered in varying amounts, depending on the cruise speed desired, to outlet port from line 68. Preferably a proportional amplifier fluidic control device is used, which will meter varying amounts to the two outlet ports, depending on the engine requirements which are monitored by that control device. One of the control ports may be provided with means for varying the port opening in response to accelerator depression. Morever, the pressures or pressure differences between the control lines 70 and 71 will be amplified by the device so that only very small control pressure signals are required to achieve the desired fuel modulation.

The remaining branches of the fuel supply system operate in much the same manner as those previously described. Fluidic component 34, preferably a variable fluidic amplifier has a normal fuel flow from supply line 74 to outlet line 76 for return to the fuel tank except when accelerating. Acceleration control is provided by operation of valve in response to accelerator 96 which varies pressure on line 80 to divert fuel from line 76 to line 78 increasing flow to ultrasonic spray head 24 to accelerate a vehicle. Manifold vacuum pressure connected to line 98 which varies in response to depression of accelerator 96 causes a variation of pressure between control lines 80 and 81 thereby controlling the volume of fuel supplied to line 78. Thus any rapid depression of the accelerator will cause an increase in fuel flow through variable fluidic amplifier 34.

Idle fluidic control 36 may also be a proportional amplifier as previously described and only functions at idle according to pressure at idle connected to line 90. The idle fluidic control is operated as a bi-stable flip-flop in which the Coanda effect distrbutes all fuel to either line 86 or line 88. At idle pressure differential between lines 90 and 91 causes all fuel to flow from inlet line 84 to outlet line 88. The pressure differential is the reference pressure of adjustably controlled, variable restriction 51. At any pressure differential substantially different than the pressure set by variable restriction 51 all fuel is diverted to line 86 and line 92 for return to the fuel tank.

As described above fluidic component 16 provides constant pressure fuel flow to line 38 from fuel tank 12 and pump 14. Preferably fluidic component 16 would include flip-flop control to return fuel to the tank; particularly if the pump is an electric pump. Thus if the engine were not running all fuel would be returned to the fuel tank unless some vacuum pressure were sensed by starting the engine this would prevent delivery of raw fuel to the engine until the engine starts to "turnover".

Under most engine demands the four fuel control branches described will be sufficient to meet most engine requirements. However, it may be desirable to include other fluidic controls to monitor requirements such as constant pressure within the fuel deliery system, ignition timing, engine wear and the like. The fluidic controls described cooperate with engine vacuum or manifold pressures so that engine wear, changes in atmospheric conditions, pressures, temperature, and even different piston position, are to some extent accounted for.

The monitoring feature will yield automatic tuning of changing engine requirements as the engine wears, by being responsive to changing engine performance such as manifold pressure, engine vacuum, compression, etc. The system disclosed offers substantial advantages over previous systems, particularly mechanically operating devices such as a carburetor, which does not sense or respond to changing engine conditions and must be frequently readjusted.

Ultrasonic atomizer utilized in combination with the fluidic control fuel delivery system, as previously explained, includes an oscillator 22, and transducer section 20 and spray head 24. Transducer 20 may be a magnetostrictive or piezoelectric apparatus. Again, such a system is described in U.S. Pat. No. 3,243,122 issued for the same inventor as the system described herein and is incorporated herein by reference. The oscillator provides electrical oscillation, usually at a frequency either in the upper audio or ultrasonic ranges, preferrably the latter. The transducer converts these electrical oscillations to corresponding mecchanical vibration which are then transmitted to the spray-head element. The spray head 24 may be a cylindrical horn with a sharp outer edge or any other suitable shape to give the desired spray pattern. A similar mechanism is disclosed in U.S. Pat. No. 3,266,631 issued to the same inventor as the invention disclosed herein. Pertinent portions relating to the transducer and its ultrasonic results are incorporated herein by reference. Ultrasonic spray device power requirement are approximately 10 watts and 12 volts at an oscillator frequency approximately 10 to 100 KHz. Particle sizes achieved by such a device are less than about 20 microns dispersed in a fixed pattern for any fuel rate up to about 20 gallons per hour. This fuel dispersing system substantially eliminates problems such as carburetor icing and flooding. The significantly improved uniform droplet dispersal pattern of the fuel and the air-fuel mixtures obtained therefrom provide a more consistent ignition charge in the cylinders, which results in cleaner burning with less residual by-products and less atmospheric pollution.

The advantages of the system disclosed are that problems of flooding, clogging, icing, cleaning, replacement, etc. are eliminated as are other generally known disadvantages of a mechanical carburetion system. The manner in which the fluidic control device meters out fuel volumes in response to engine requirements, also improves fuel consumption because fuel is supplied only in response to engine demand. This results in less pollution, improved engine performance and reliability, and less frequent and lower engine and fuel delivery system maintenance costs.

This invention is not to be limited by the embodiments shown in the drawings and described in the description, which are given by way of example and not of limitation, but only in accordance with the scope of the appended claims.

I claim:

1. A fuel supply system for an internal combustion engine comprising;

a fuel tank;

a carburetor;

a plurality of fluidic control means having inlets and a plurality of outlets, said plurality of outlets supplying fuel from said tank to said carburetor in said engine; said fluidic control means including at least a separate fluidic control for starting, idling, accelerating, and cruising conditions respectively;

pump means pumping fuel from said fuel tank to said fluidic control means; said pump means including constant pressure fluidic control means;

ultrasonic spray means in said carburetor connected to receive fuel from said plurality of fluidic control means and discharge the fuel into said engine;

responsive means responsive to an engine condition connected to a control line in each of said plurality of fluidic control means;

whereby each of said fluidic control means responds to an engine condition being monitored by said responsive means to increase or decrease fuel supply at constant pressure to said ultrasonic spray means.

2. The fuel supply system according to claim 1 in which said fluidic control means are selected from the group consisting of bi-stable flip-flop fluidic controls, proportional amplifying fluidic controls and variable amplifying fluidic controls.

3. The fuel supply system according to claim 1 in which there are four fluidic control branches;

each of said fluidic branches having at least one fluidic control means; each of said fluidic branches having at least one of said responsive means connected to monitor and respond to choke, idle, acceleration and cruise engine conditions respectively.

4. The fuel supply system according to claim 3 in which said responsive means responsive to engine idle conditions comprises;

means connecting said fluidic control means to engine vacuum pressure; and temperature responsive means for varying the engine vacuum pressure in said vacuum pressure connecting means.

5. The fuel supply system according to claim 3 in which said responsive means responsive to said engine acceleration conditions comprises; means connecting engine vacuum to a control line of one of said fluidic control means; and means responsive to accelerator position for varying the pressure applied in said engine vacuum connecting means.

6. The fuel supply system according to claim 3 in which said responsive means comprises; means connecting a control line in said fluidic component to engine vacuum pressure whereby said fluidic element provides constant fuel flow at cruising speeds.

7. The fuel supply system according to claim 6 in which said connecting means connects said fluidic component to air pressure at a Venturi adjacent said spray head.

8. The system of claim 7 in which said ultrasonic atomizer comprises an oscillator for generating electrical oscillations at a selected ultrasonic frequency, a transducer coupled to the oscillator for converting the electrical oscillations to mechanical vibrations, and a spray head cooperating with the transducer and having an atomizing surface for spraying fuel in response to the mechanical vibrations.

* * * * *